US007950521B2

(12) United States Patent
Apps

(10) Patent No.: US 7,950,521 B2
(45) Date of Patent: May 31, 2011

(54) LOW DEPTH STACKABLE TRAY

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 12/757,092

(22) Filed: Apr. 9, 2010

(65) Prior Publication Data

US 2010/0258467 A1 Oct. 14, 2010

Related U.S. Application Data

(60) Provisional application No. 61/168,260, filed on Apr. 10, 2009.

(51) Int. Cl.
*B65D 1/36* (2006.01)

(52) U.S. Cl. ..... 206/203; 220/509

(58) Field of Classification Search ..... 206/139, 206/140, 203, 427; 220/509, 513, 516, 517, 220/518, 519
See application file for complete search history.

(56) References Cited

U.S. PATENT DOCUMENTS

| | | | | |
|---|---|---|---|---|
| 3,701,449 | A * | 10/1972 | Schoeller et al. | 220/519 |
| 3,788,002 | A * | 1/1974 | Suchka | 47/85 |
| 5,060,819 | A * | 10/1991 | Apps | 220/519 |
| 5,487,487 | A * | 1/1996 | Hammett | 220/509 |
| 5,660,279 | A | 8/1997 | Apps et al. | |
| 7,658,278 | B2 * | 2/2010 | Apps et al. | 206/203 |
| 2002/0148837 | A1 | 10/2002 | Apps | |
| 2003/0057211 | A1 * | 3/2003 | Koefelda et al. | 220/518 |
| 2005/0017063 | A1 | 1/2005 | Noone et al. | |
| 2005/0279651 | A1 * | 12/2005 | Perret et al. | 206/203 |

FOREIGN PATENT DOCUMENTS

| | | | |
|---|---|---|---|
| AU | 705 846 | B2 | 6/1999 |
| EP | 0 915 021 | A1 | 5/1999 |
| WO | 00/75027 | A1 | 12/2000 |

OTHER PUBLICATIONS

European Search Report for EP Application No. 10159681.5, Aug. 9, 2010.
Photograph of Pepsi—Blue Crate, Top View.
Photograph of Pepsi—Blue Crate, Bottom View 1.
Photograph of Pepsi—Blue Crate, Bottom View 2.
Photograph of Norseman NPL 405 Crate, Top View.
Photograph of Norseman NPL 405 Crate, Bottom View.
Photograph of Coca Cola Crate, Top View.
Photograph of Coca Cola Crate, Bottom View.
Photograph of 2L Coca Cola "Tulip" Crate, Top View.
Photograph of 2L Coca Cola "Tulip" Crate, Bottom View 1.
Photograph of 2L Coca Cola "Tulip" Crate, Bottom View 2.
Photograph of 2L Coca Cola "Tulip" Crate, Bottom View 3.

* cited by examiner

*Primary Examiner* — Jacob K Ackun, Jr.
(74) *Attorney, Agent, or Firm* — Carlson, Gaskey & Olds

(57) ABSTRACT

A tray for containers, such as beverage bottles, includes a base and a plurality of interior columns extending upwardly from the base. A plurality of columns extend upwardly along at least a portion of the periphery of the tray. Side walls extend along the sides of the tray and end walls extend along the ends of the tray, the end walls connected to the side walls by corner walls. The corner walls protrude upwardly higher than the side walls and end walls and include an opening at a lower edge thereof for receiving a corner portion of an identical tray nested therebelow. In another, independent feature, dividers and/or the walls include recesses along uppermost edges to reduce the overall footprint of the tray.

19 Claims, 10 Drawing Sheets

LOW DEPTH STACKABLE TRAY

This application claims priority to U.S. Provisional Application Ser. No. 61/168,260, filed Apr. 10, 2009.

BACKGROUND

The present invention relates to a stackable low depth tray for storing and transporting beverage containers, such as bottles.

Plastic bottles are widely used as containers for soft drinks and other beverages. These bottles are often stored and transported in trays, particularly plastic trays having side walls, end walls and dividers dividing pockets between the side walls and end walls. There are many known tray designs that are referred to as "low depth" trays in which the side walls, end walls and dividers are lower than the height of the stored bottles, and in which the bottles support the weight of additional trays and bottles stacked thereon.

SUMMARY

The present invention relates to a stackable low depth tray for storing and transporting beverage containers, such as bottles.

The example tray includes a base and a plurality of interior columns extending upwardly from the base. A plurality of columns extend upwardly along at least a portion of the periphery of the tray. Side walls extend along the sides of the tray and end walls extend along the ends of the tray, the end walls connected to the side walls by corner walls. The corner walls protrude upwardly higher than the side walls and end walls and include an opening at a lower edge thereof for receiving a corner portion of an identical tray nested therebelow. In another, independent feature, dividers and/or the walls include recesses along uppermost edges to reduce the overall footprint of the tray.

DETAILED DESCRIPTION OF A PREFERRED EMBODIMENT

Figure 1:
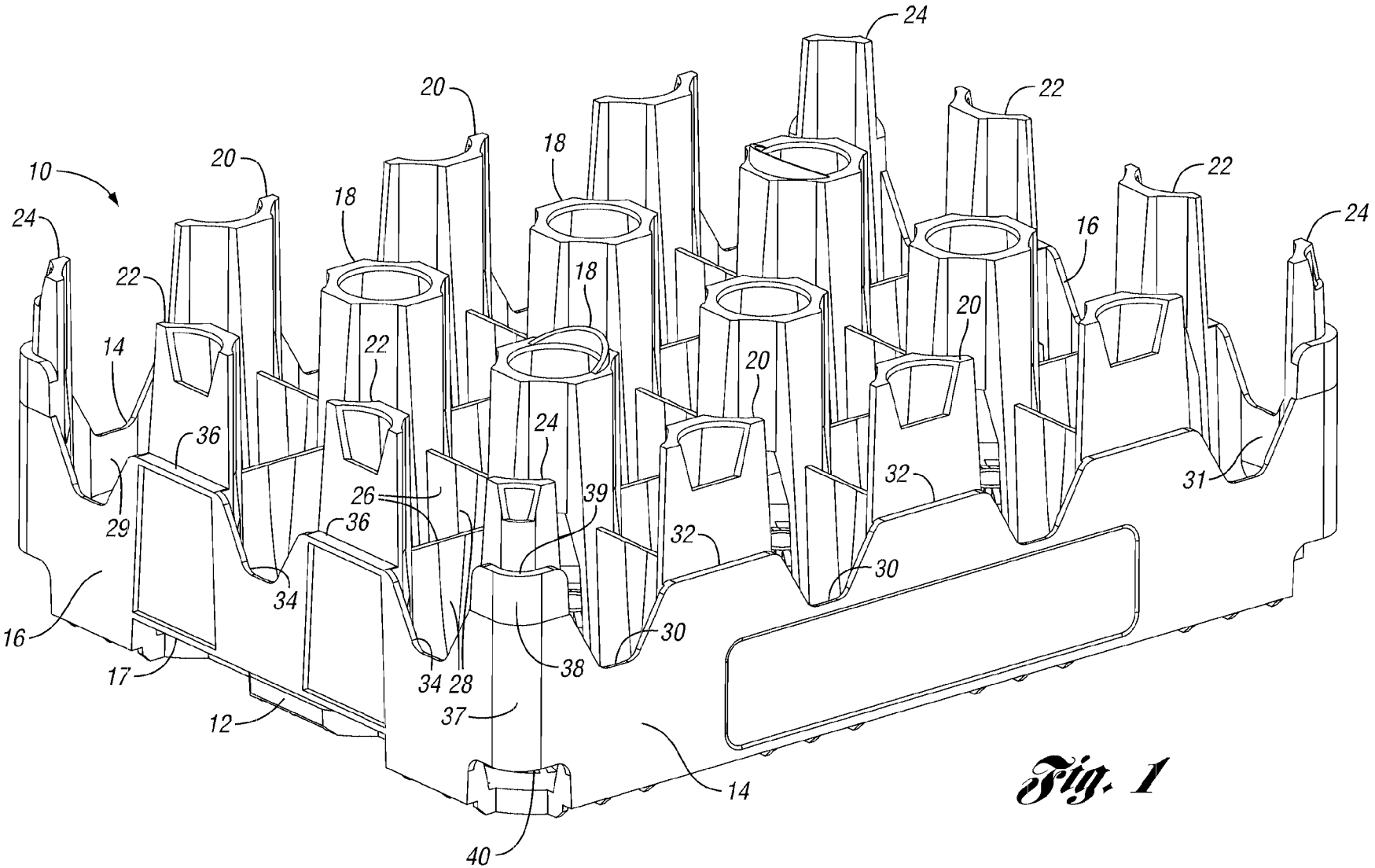
FIG. 1 is a perspective view of a tray according to one embodiment of the present invention.

A tray 10 according to one embodiment of the present invention is shown in FIG. 1. The tray 10 of this example is configured for holding 1.5 liter plastic beverage containers in a 3 by 4 arrangement. Modifications to the tray 10 to accommodate bottles of other sizes and different numbers of bottles would still be within the scope of this invention.

The tray 10 includes a base 12, side walls 14 and end walls 16. Handle openings 17 are formed at the bottom of each end wall 16. Interior columns 18 (six in this example) extend upwardly from the base 12. Side columns 20 extend upwardly from the base 12 along the side walls 14 of the tray 10. End columns 22 extend upwardly from the base 12 adjacent the end walls 16. In this configuration, there are three side columns 20 on each side and two end columns on each end, but these numbers depend on the number of pockets to be formed. Corner columns 24 extend upwardly from the base 12 at each corner of the tray 10.

Dividers 26 extend laterally and longitudinally between adjacent columns 18, 20, 22, 24. Bottle receiving pockets are defined by the dividers 26 and columns. To accommodate larger bottles within a smaller tray footprint, each of the dividers 26 includes a recessed portion 28 (or a scallop) adjacent an uppermost edge thereof. Similarly, the side walls 14 include a recessed portion 29 adjacent each window 30 and the end walls 16 include a recessed portion 31 adjacent each window 34. The side walls 14 include windows 30 opening upwardly between columns 20. The side walls 14 define outer ledges 32 adjacent each side column 20. The end walls 16 include windows 34 opening upwardly between end columns 22. The end walls 16 define outer ledges 36 adjacent the end columns 22.

In the corners, a corner wall 37 includes an upper portion 38 defining an outer ledge 39 adjacent the corner column 24. The upper portion 38 of the corner wall 37 is defined approximately as the extent to which the corner wall 37 extends above a plane defined by the outer ledges 32, 36. The outer ledge 39 adjacent the corner column 24 is therefore higher than the outer ledges 32, 36 adjacent the side and end columns 20, 22. The corner wall 37 includes an opening 40 at its lower most edge, the opening sufficient in size to receive the upper portion 38 of the corner wall 37, and in this example, the opening 40 is complementary to the upper portion 38 of the corner wall 37.

All of the columns in the tray 10 are taller than many known trays, while still providing a relatively small footprint (not much larger than the bottles themselves). This would ordinarily provide a very narrow, fragile corner column (which is approximately one-quarter the width of the interior columns). Therefore, in order to strengthen the corner column 24, the corner wall 37 is extended upwardly to reinforce the corner column 24. This upper portion 38 of the corner wall 37 is accommodated in the opening 40 to permit normal nesting of the trays.

Figure 2:
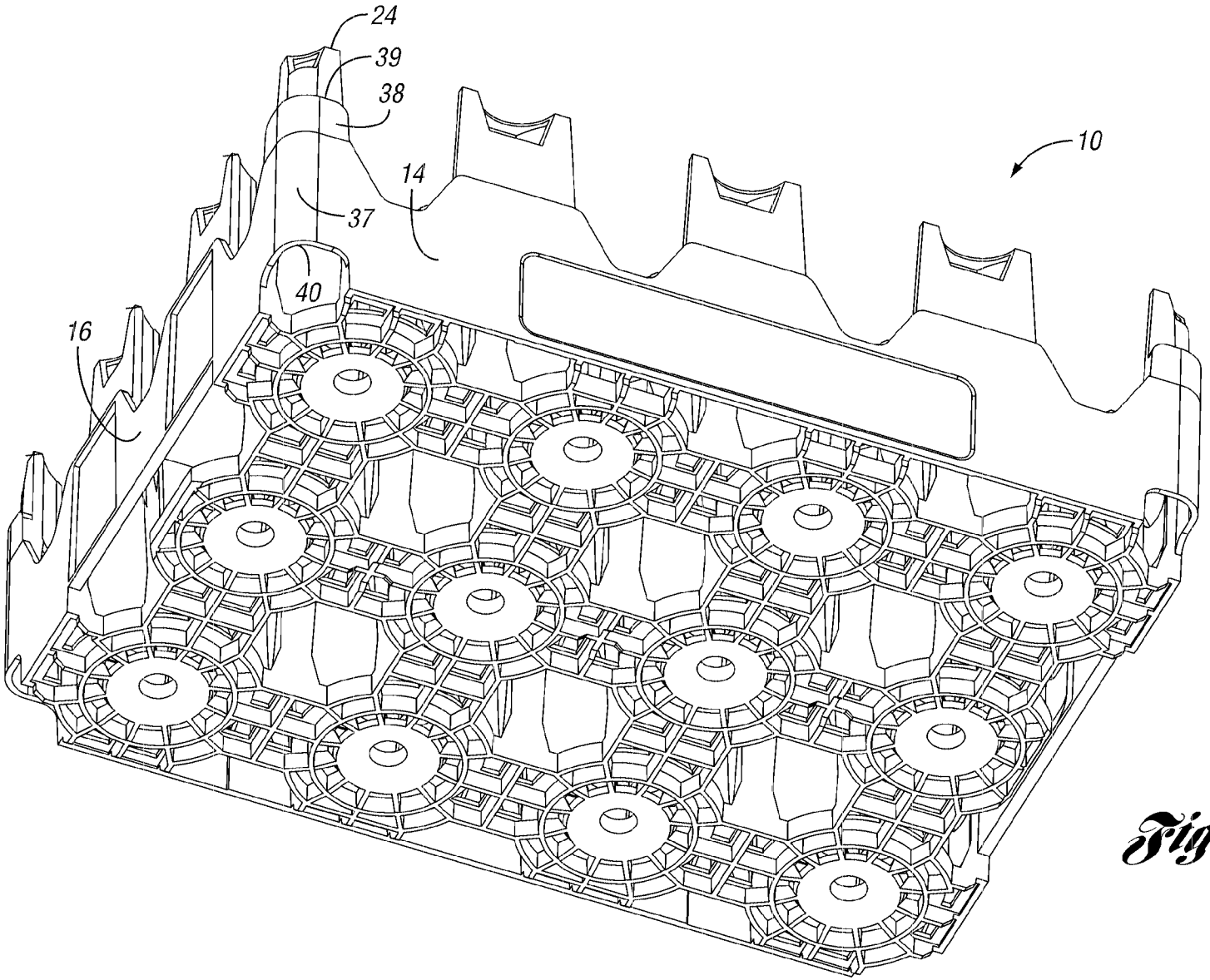
FIG. 2 is a bottom perspective view of the tray.

FIG. 2 is a bottom perspective view of the tray 10. As shown, the opening 40 is generally complementary to the upper portion 38 of the corner wall 37. The base 12 includes openings corresponding to the columns, such that the columns of a similar tray could be received through the openings and into correspond columns on the tray 10. The openings through the base 12 for receiving the corner columns 24 are open outwardly and contiguous with the opening 40 through the corner wall 37.

Figure 3:
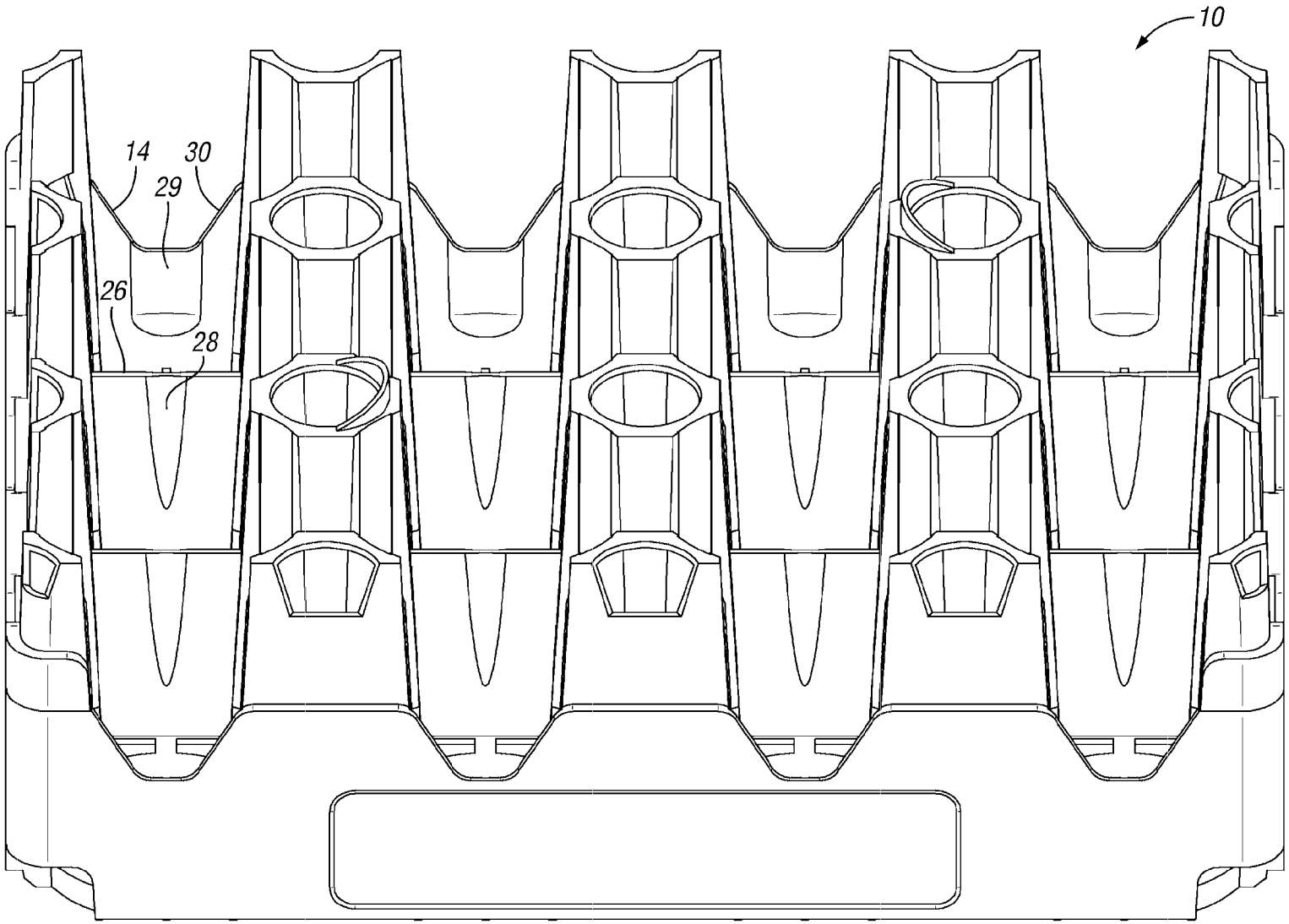
FIG. 3 is a side perspective view of the tray.

FIG. 3 is a side perspective view of the tray 10, illustrating the recesses 28 on the dividers 26 and the recesses 29 on the side walls 14, aligned with each pocket.

Figure 4:
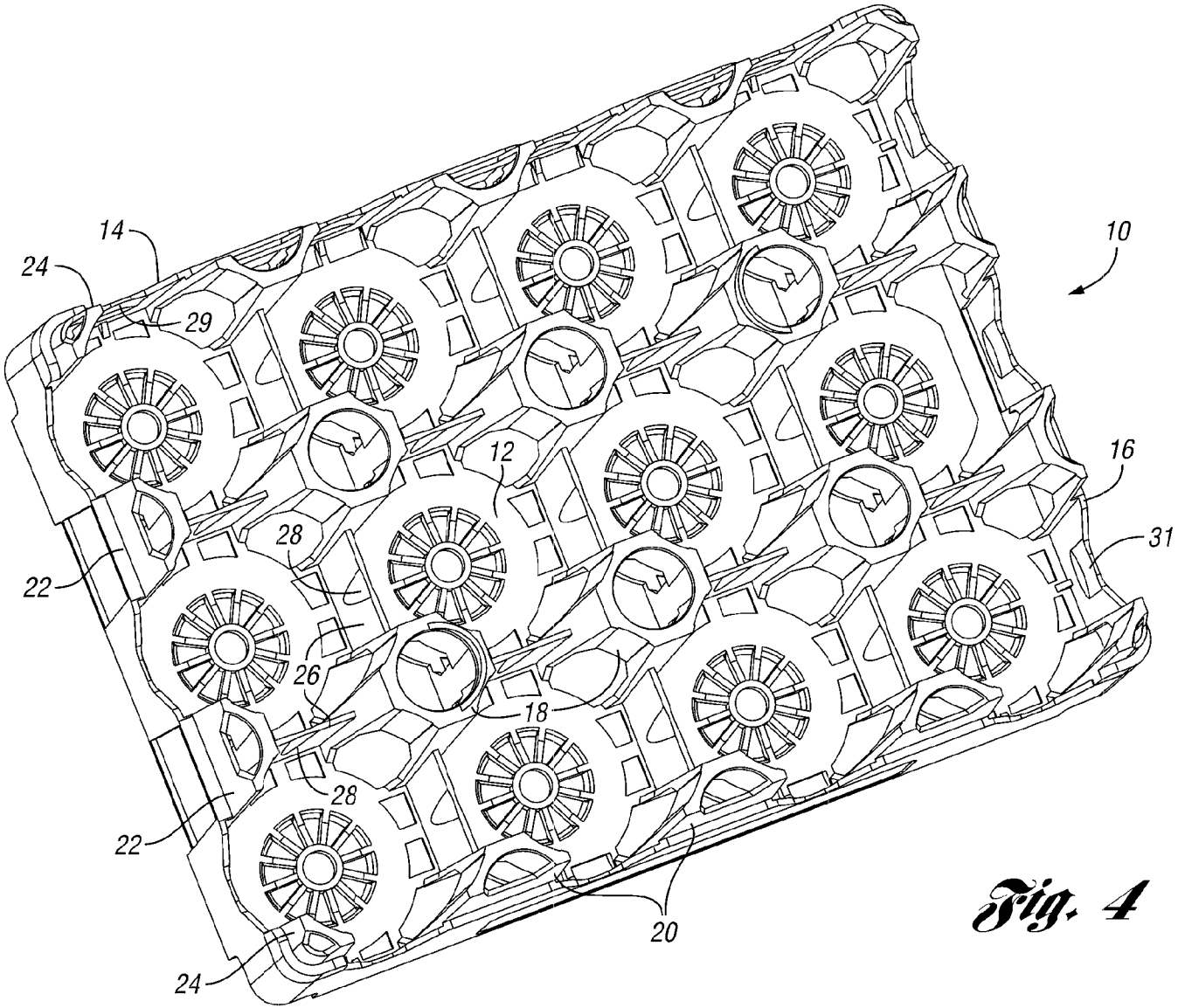
FIG. 4 is a top perspective view of the tray.
Figure 5:
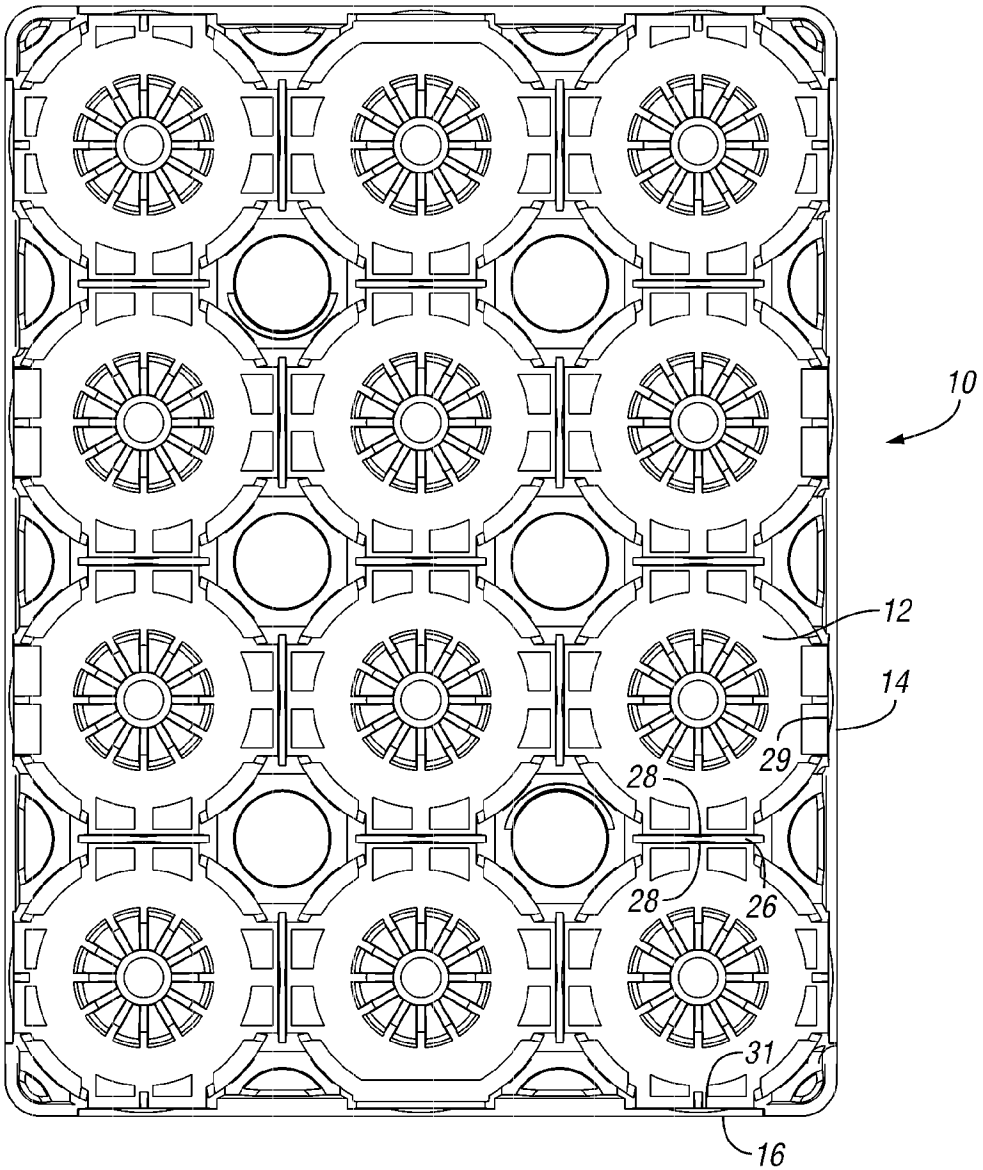
FIG. 5 is a top view of the tray.

FIG. 4 is a top perspective view of the tray 10, again shown in the recesses 29 in the side walls 14 adjacent each pocket and the recesses 28 in the dividers 26 and the recesses 31 in the end walls 16, adjacent each pocket. As shown in FIG. 5, the dividers 26 include the recesses 28 on each side of the divider, such that the divider 26 is significantly thinner at the center of its upper edge. The recesses 31 in the end walls 16 and the recesses 29 in the side walls 14 are only formed on the interior surface, adjacent the pocket.

Figure 6:
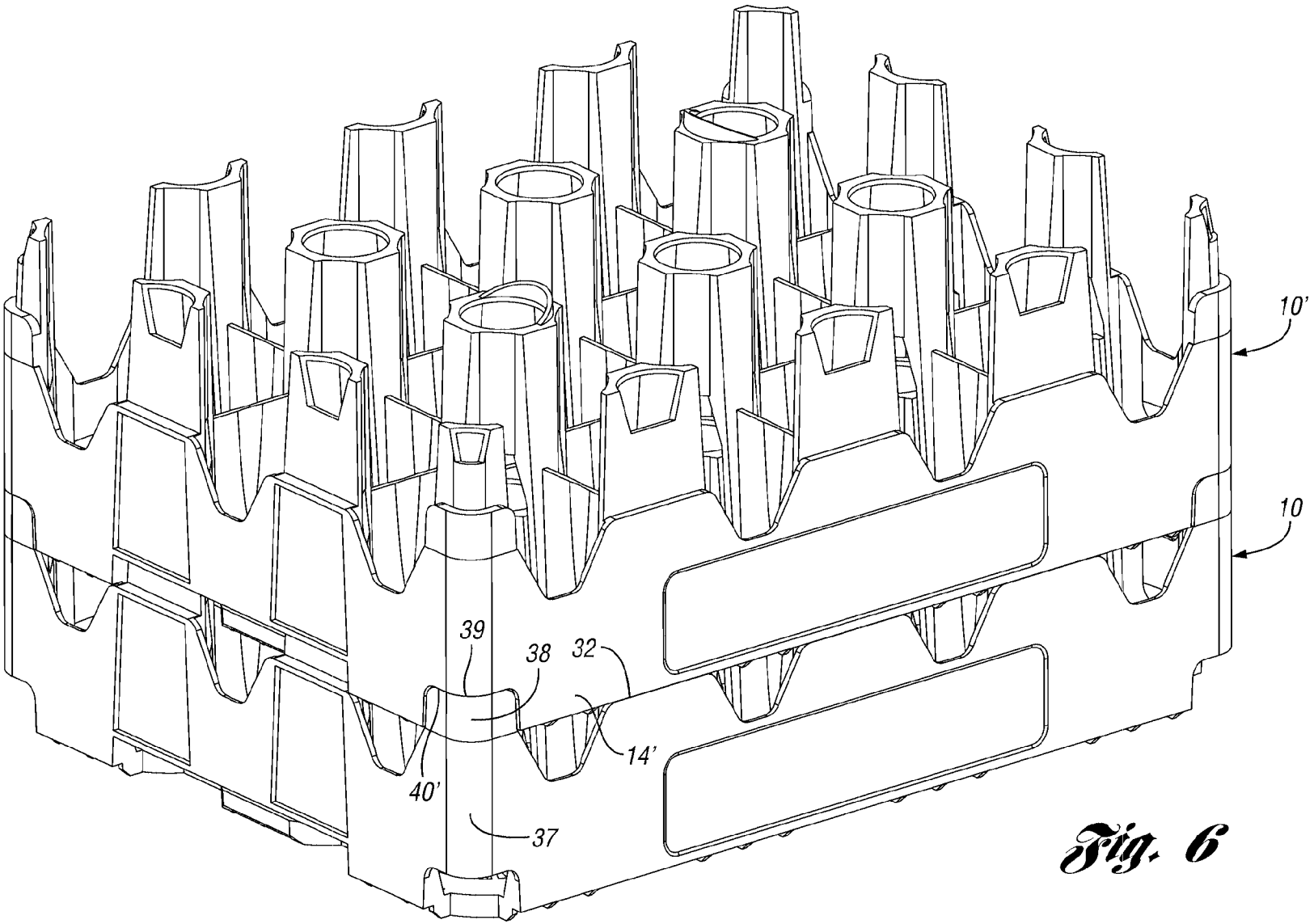
FIG. 6 is a perspective view of the tray with a similar tray stacked thereon.

FIG. 6 illustrates the tray 10 with a similar tray 10' stacked thereon. As shown, the side walls 14' of the upper tray 10' rest on the outer ledges 32 of the lower tray 10. Further, the upper portion 38 of the corner wall 37 of the lower tray 10 is received within the corner opening 40' of the upper tray 10', the edge of which rests on the outer ledge 39 of the lower tray 10. The configuration of the corners provides a stable stacking configuration, while also providing strong corner structure for the tray 10.

Figure 7:
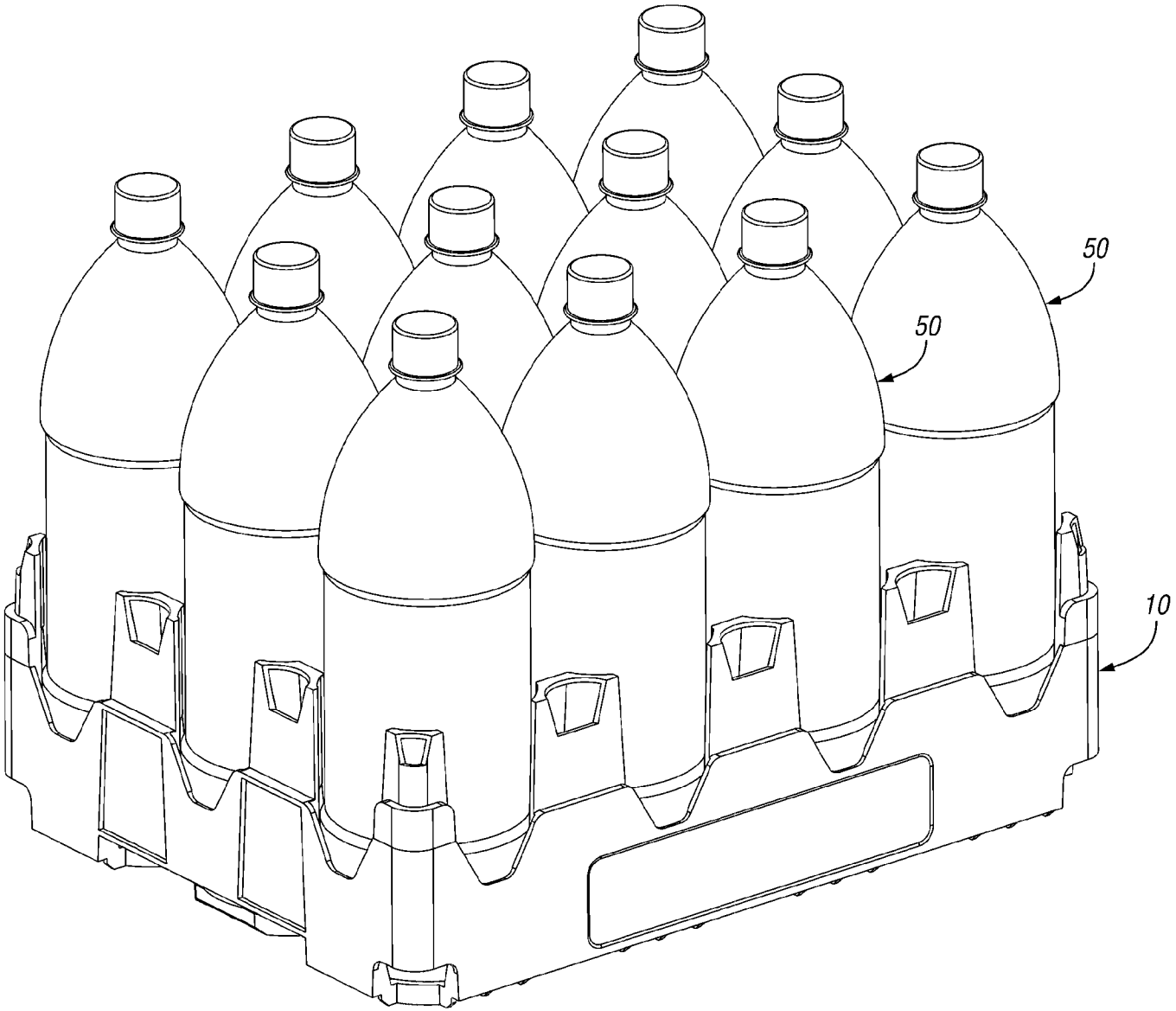
FIG. 7 is a perspective view of the tray loaded with a plurality of beverage bottles.

FIG. 7 illustrates the tray 10 with a plurality of bottles 50 in the pockets. Although not visible in this Figure, the bottles 50 would be partially received in the recesses 28, 29, 31 (FIG. 4).

Figure 8:
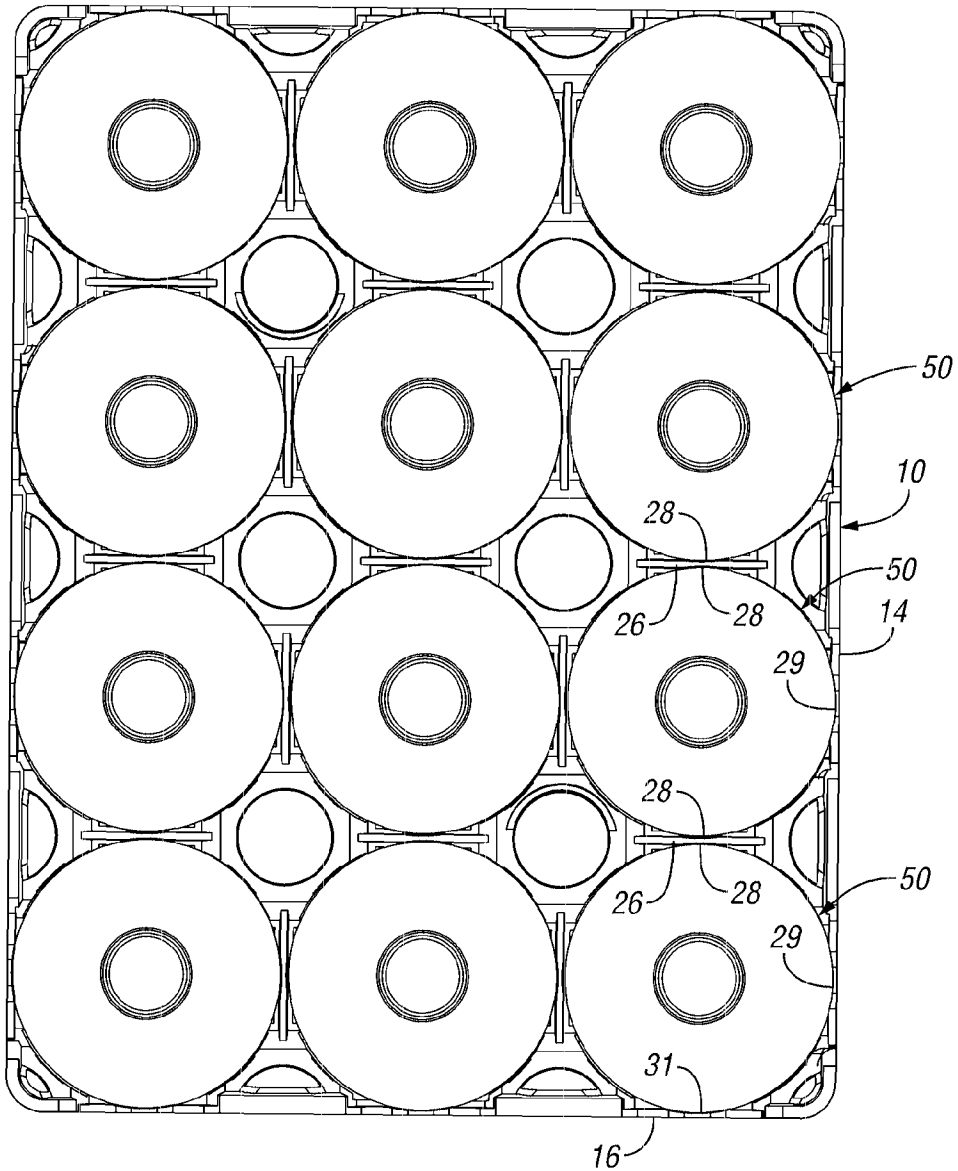
FIG. 8 is a top view of the tray and bottles of FIG. 7.
Figure 9:
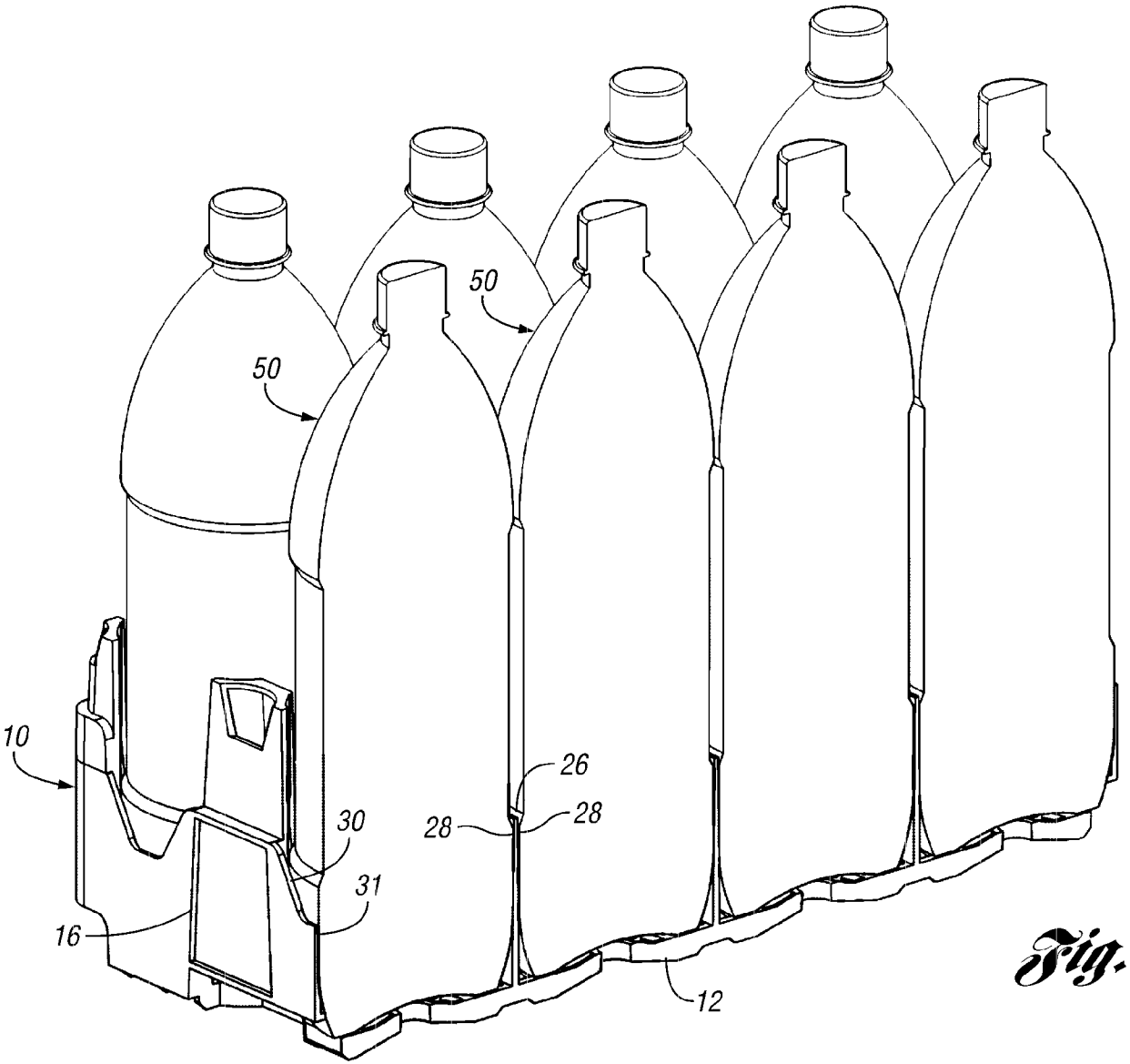
FIG. 9 illustrates the tray and bottles of FIG. 7 broken away.
Figure 10:
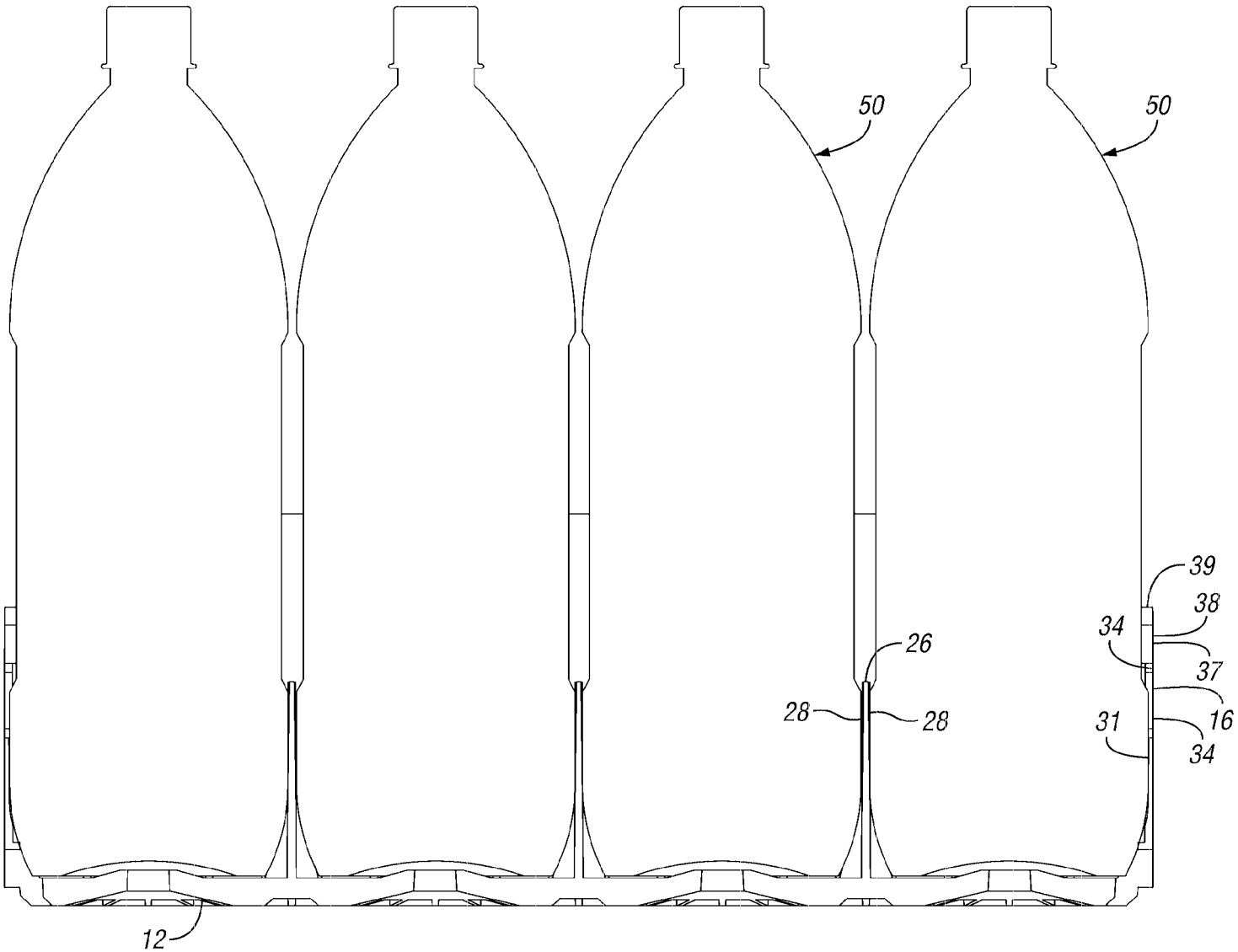
FIG. 10 is a section view of the tray and bottles of FIG. 7.

FIG. 8 is a top view of the tray 10 and bottles 50. As shown, the diameter of the bottles 50 extends into the recesses 28 in the dividers 26, the recesses 29 in the side walls 14 and the recesses 31 in the end walls 16. As shown in FIGS. 9 and 10, forming the recess only adjacent the upper edge of the dividers 26 and end walls 16 is sufficient because of the normal taper at the bottom of the bottles 50. The recesses 28 taper the divider 26 to its upper edge, following the curve of the taper of the bottle 50. The recesses 29 in the side walls 14 are similar.

As shown in FIG. 10, the outer ledges 39 on the upper portion 38 of the corner walls 37 are at a first height. The outer ledges 34 (and outer ledges 32, FIG. 1) are at a second height, lower than the first height. The dividers 26 are at a third height, lower than the outer ledges 32, 34. The windows 30, 34 extend down to a fourth height, lower than the third height.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

The invention claimed is:

1. A tray for containers comprising:
a base for supporting containers thereon;
a plurality of interior columns extending upwardly from the base;
a plurality of side columns along sides of the tray;
a plurality of corner columns at corners of the tray;
side walls extending along the sides of the tray; and
end walls extending along the ends of the tray, the end walls connected to the side walls by corner walls, the corner walls protruding upwardly higher than the side walls and end walls, the corner walls each including an opening at a lower edge thereof for receiving a corner portion of an identical tray nested therebelow.

2. The tray of claim 1 wherein the side walls include a plurality of windows opening upwardly between adjacent pairs of side columns.

3. The tray of claim 2 wherein the end walls include a plurality of windows opening upwardly between adjacent pairs of end columns.

4. The tray of claim 1 wherein the corner walls form outer ledges adjacent exterior surfaces of the corner columns.

5. The tray of claim 1 further including a plurality of dividers extending between the interior columns.

6. The tray of claim 5 wherein the dividers include recesses adjacent uppermost edges of the dividers.

7. The tray of claim 1 wherein the side walls include recesses on interior surfaces adjacent uppermost edges thereof.

8. A tray for containers comprising:
a base for supporting containers thereon;
a plurality of interior columns extending upwardly from the base;
a plurality of columns along at least a portion of a periphery of the base; and
a plurality of single-wall dividers extending between the interior columns, wherein the dividers include recesses adjacent uppermost edges of the dividers, such that the dividers have reduced thickness at a center of uppermost edges of the dividers.

9. The tray of claim 8 further including side walls extending along the sides of the tray and end walls extending along the ends of the tray.

10. The tray of claim 9 wherein the side walls include a plurality of windows opening upwardly between adjacent pairs of side columns.

11. The tray of claim 9 wherein the end walls include a plurality of windows opening upwardly between adjacent pairs of end columns.

12. The tray of claim 8 wherein the side walls include recesses on interior surfaces adjacent uppermost edges thereof.

13. A tray for containers comprising:
a base for supporting containers thereon;
a plurality of columns along at least a portion of the periphery of the tray;
a plurality of corner columns at corners of the tray;
side walls extending along at least a portion of the sides of the tray; and
corner walls protruding upwardly higher than the side walls, the side walls connected to the corner walls, the corner walls each including an opening at a lower edge thereof for receiving a corner portion of an identical tray nested therebelow, the base including openings corresponding to the corner columns, such that corner columns of an identical tray would be received through the openings and into correspond corner columns on the tray, wherein the openings are open outwardly and contiguous with the opening through the corner wall.

14. The tray of claim 13 wherein the side walls include a plurality of windows opening upwardly between adjacent pairs of side columns.

15. The tray of claim 14 further including end walls including a plurality of windows opening upwardly between adjacent pairs of end columns.

16. The tray of claim 13 wherein the corner walls form outer ledges adjacent exterior surfaces of the corner columns.

17. The tray of claim 13 further including a plurality of dividers extending between the interior columns.

18. The tray of claim 17 wherein the dividers include recesses adjacent uppermost edges of the dividers.

19. The tray of claim 18 wherein the side walls include recesses on interior surfaces adjacent uppermost edges thereof.

* * * * *